US005657492A

United States Patent [19]

Esposito, Jr.

[11] Patent Number: 5,657,492

[45] Date of Patent: Aug. 19, 1997

[54] PROTECTIVE HEAD DEVICE

[76] Inventor: Joseph M. Esposito, Jr., 9 Wyoming Rd., Newtonville, Mass. 02160

[21] Appl. No.: 527,951

[22] Filed: Sep. 14, 1995

[51] Int. Cl.[6] ..... A42B 3/00

[52] U.S. Cl. ..... 2/410; 2/181; 2/209.13; 2/195.1

[58] Field of Search ..... 2/410, 412, 414, 2/421, 422, 425, 209.12, 195.1, 195.5, 411, 415, 209.13, 195.2, 181, 205

[56] References Cited

U.S. PATENT DOCUMENTS

| | | | |
|---|---|---|---|
| 3,103,014 | 9/1963 | Morgan | 2/415 |
| 3,103,015 | 9/1963 | Plastino | 2/422 |
| 3,230,544 | 1/1966 | Mager | 2/415 |
| 3,242,500 | 3/1966 | Derr | 2/412 |
| 3,245,087 | 4/1966 | Marchello | 2/422 |
| 3,323,134 | 6/1967 | Swyers | 2/415 |
| 3,445,860 | 5/1969 | Rodell | 2/422 |
| 3,457,563 | 7/1969 | Marchello | 2/414 |
| 3,591,863 | 7/1971 | Rickard . | |
| 3,906,546 | 9/1975 | Gooding | 2/414 |
| 3,946,441 | 3/1976 | Johnson | 2/412 |
| 4,404,690 | 9/1983 | Farquharson | 2/425 |
| 4,439,871 | 4/1984 | Plastino | 2/422 |
| 4,446,576 | 5/1984 | Hisataka | 2/425 |
| 4,477,929 | 10/1984 | Mattsson | 2/425 |
| 4,558,470 | 12/1985 | Mitchell et al. | 2/414 |
| 4,599,752 | 7/1986 | Mitchell | 2/425 |
| 4,677,694 | 7/1987 | Crow | 2/425 |
| 4,698,856 | 10/1987 | Arai | 2/425 |
| 5,086,520 | 2/1992 | Arai | 2/424 |
| 5,136,657 | 8/1992 | Hattori | 381/187 |
| 5,226,180 | 7/1993 | Leach | 2/195.1 |
| 5,271,103 | 12/1993 | Darnell | 2/418 |
| 5,272,773 | 12/1993 | Kamata | 2/421 |
| 5,289,591 | 3/1994 | Andersen | 2/195.5 |
| 5,337,420 | 8/1994 | Haysom et al. | 2/410 |
| 5,351,342 | 10/1994 | Garneau | 2/414 |
| 5,381,560 | 1/1995 | Halstead | 2/421 |
| 5,418,981 | 5/1995 | Miner | 2/209.13 |
| 5,421,035 | 6/1995 | Klose et al. | 2/411 |
| 5,437,064 | 8/1995 | Hamaguchi | 2/414 |
| 5,481,759 | 1/1996 | Rinaldi | 2/195.1 |

*Primary Examiner*—Michael A. Neas

*Attorney, Agent, or Firm*—Lahive & Cockfield, LLP; Anthony A. Laurentano

[57] ABSTRACT

A protective head apparatus that includes a hard, impact resistant outer body portion having a convex outer surface and a concave inner surface. A padding layer, forming a cushioning element, is coupled to the concave inner surface of the outer body portion. Appropriate attachment structure is provided for mounting the head covering to conventional headwear, including one or more raised bridge structures that are integrally formed with the convex outer surface of the body portion. The outer body portion of the protective head apparatus is sized to seat exclusively over the posterior portion of the wearer's head.

4 Claims, 2 Drawing Sheets

PROTECTIVE HEAD DEVICE

BACKGROUND OF THE INVENTION

The present invention broadly relates to protective head coverings, and more particularly to protective head coverings for use during sporting or recreational activities.

Individuals that participate in sporting and recreational activities that include the risk of injury usually wear protective headgear. For example, since rollerblading introduces the risk of head injuries, participants are encouraged to wear commercially available protective headwear.

Conventional headwear typically includes helmets formed of lightweight rigid materials that cover a substantial portion of the wearer's head. Although lightweight and ergonomically designed, they tend to be relatively bulky and thus difficult to transport. Furthermore, these helmets tend to be unsightly and aesthetically unappealing. As younger individuals are rather fashion conscious and tend to travel light, the foregoing shortcomings lessens the likelihood that conventional helmets will be worn.

Another deterrent to procuring and wearing protective headwear is the cost. Most conventional protective helmets are relatively expensive. Consequently, participants that should be wearing helmets often do not, thus substantially increasing the chance of these individuals suffering head injuries.

Due to the foregoing and other shortcomings of full head helmets for use during recreational and sporting activities, an object of this invention is to provide a novel protective head covering that is adaptable for use and thus compatible with aesthetically appealing conventional headwear, such as baseball caps.

Another object of this invention is to provide a protective head device that is relatively lightweight, relatively low cost, and relatively comfortable.

Still another object of the invention is to provide a protective head covering that has relatively few components, and is relatively easy to manufacture.

Yet another object of the invention is to provide a protective head covering that is relatively easy to use.

Other general and more specific objects of the invention will in part be obvious and will in part appear from the drawings and description which follow.

SUMMARY OF THE INVENTION

The present invention provides a protective head covering that seats over a posterior portion of the wearer's head. The head covering preferably secures to conventional headwear, particularly those employing an adjustable strap. The protective head covering when mounted to the headwear provides an additional degree of protection against impact suffered from falls that occur during participation in recreational and sporting activities.

The protective head apparatus of the invention includes a hard, impact resistant outer body portion that has a convex outer surface and a concave inner surface. A padding layer, forming a cushioning element, is coupled to the concave inner surface of the outer body portion. Appropriate attachment structure is provided for mounting the head covering to conventional headwear. The appropriate attachment can include one or more raised bridge structures that are integrally formed with the convex outer surface of the body portion. Other suitable attachment assemblies can include a plurality of apertures or slits for mounting either the adjustable strap of the headwear or for mounting an elastic band.

According to one aspect, the body portion of the protective head apparatus is sized to seat exclusively over the posterior portion, e.g., over the occipital protuberance, of the wearer's head. According to one preferred embodiment, the headwear is a baseball, football or hockey hat.

According to another practice, the protective head device of the present invention includes a hard, impact resistant outer shell having a convex outer surface and a concave inner surface. A padding layer is provided and is coupled to the concave inner surface of the outer shell. A securing mechanism, such as rivets or other like mechanical fasteners, secures the padding layer to the inner surface of the shell. Additionally, structure is provided for allowing the apparatus to mount to headwear having an adjustable strap. According to one preferred practice, the outer shell has a selected configuration that is sized to seat exclusively over a portion of the posterior portion of a wearer's head.

BRIEF DESCRIPTION OF THE DRAWINGS

The foregoing and other objects, features and advantages of the invention will be apparent from the following description and apparent from the accompanying drawings, in which like reference characters refer to the same parts throughout the different views. The drawings illustrate principles of the invention and, although not to scale, show relative dimensions.

DESCRIPTION OF ILLUSTRATED EMBODIMENTS

The protective head covering 10 of the present invention is designed to seat over the posterior portion, and particularly the occipital region, of a wearer's head. The head covering, when mounted thereover, provides the participant with a certain degree of protection against impact suffered from falls occurring during participation in recreational and sporting activities.

Figure 1:
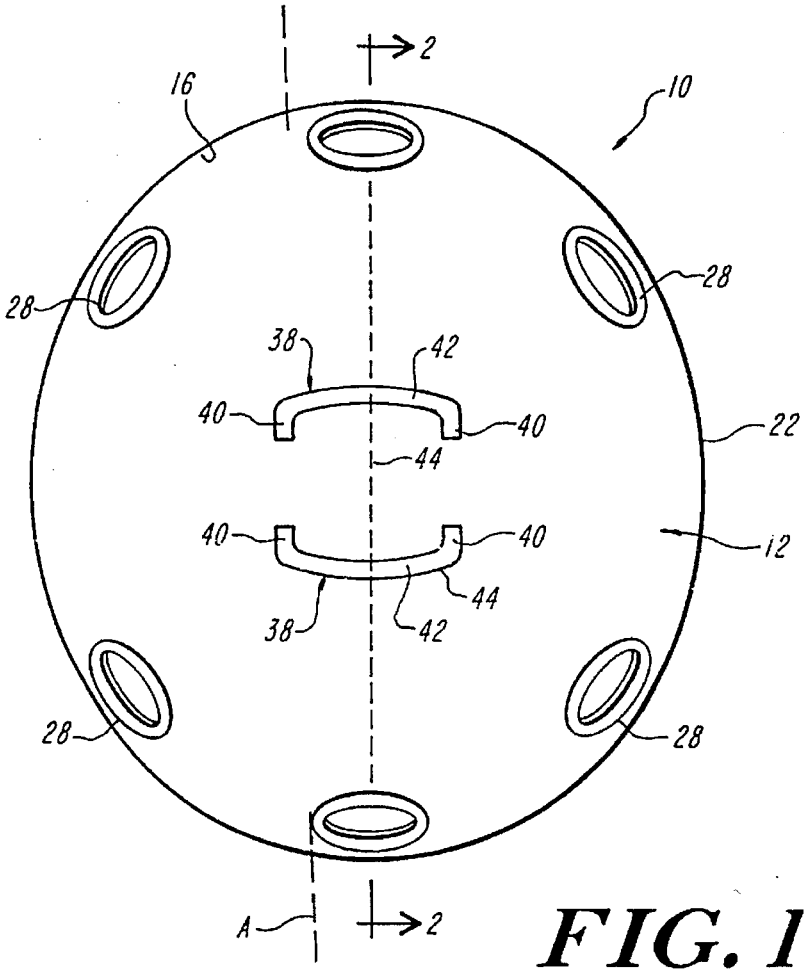
FIG. 1 is a top view of the head protective covering of the present invention.
Figure 2:
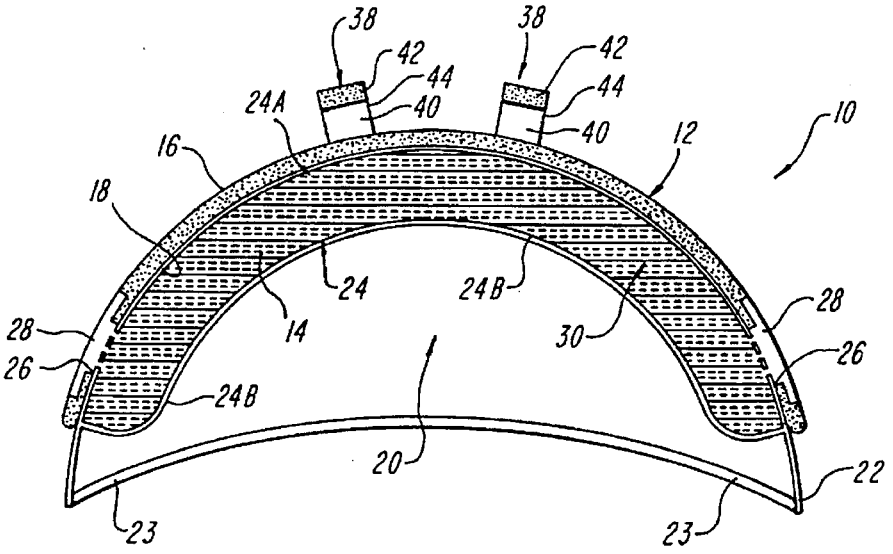
FIG. 2 is a cross-sectional view of the protective head covering of FIG. 1 taken along line 2—2.

FIGS. 1 and 2 illustrate the protective head covering 10 of the present invention. The head covering is sized to seat over the posterior portion of a wearer's head, and particularly over the occipital region or occipital protuberance of the head. The head covering 10 includes a non-porous, protective, impact-resistant outer shell 12 that has a substantially convex outer surface 16 and a concave inner surface 18. The shell 12 is preferably formed of a lightweight, strong, and substantially hard impact attenuating material such as polypropylene or ABS or similar plastic material or synthetic resins. Other suitable materials for the shell 12 are known in the art and include polycarbonate plastics, glass reinforced polyester, polyethylene, and polycarbonate acrylonitrile butadiene-styrene copolymers. The shell can be of substantially uniform thickness, ranging between about 0.05 inches and about 0.40 inches. Although depicted as being of uniform thickness, those of ordinary skill will readily recognize that the thickness of the shell can vary along the arc of the shell, and can be thicker toward the center or apex of the shell to provide additional strength and resistance against impact.

The illustrated head covering 10 mounts a padding layer 14 within the concavity 20 formed by the shell 12 by way of suitable mounting hardware. According to one practice, the padding layer 14 is secured within the concavity 20 by a nylon sling 24 and a plurality of rivets 28 that seat within corresponding holes 26 formed through the shell 12. The nylon sling 24 has a first portion 24A that is adjacent the inner concave surface 18 of the shell and is attached thereto by the rivets 28, and a second portion 24B that is coupled to the first portion 24A. The second portion 24B preferably is free of rivets 28, and thus forms in combination with the first portion 24A a pad receiving compartment 30. The compartment 30 mountingly receives the padding layer 14 and thus supports the padding layer within the concavity 20. The padding layer 14 preferably has a selected thickness and degree of cushioning sufficient to absorb shocks incurred during use. The padding layer 14 also prevents the inner surface 18 of the shell 12 from contacting the head of the wearer. Furthermore, the padding layer 14 helps form a desirable fit by allowing the head covering 10 to mate with the specific contours of the wearer's head. The padding material can be formed of any suitable shock-absorbing material, such as polystyrene and expanded polystyrene and urethane foam, e.g., styrofoam, and molded cellular polymer materials, including copolymers of styrene and maleic anhydride or acrylonitrile, polyethylene, polypropylene or ethylene-propylene copolymers.

Although depicted as a unitary body, those of ordinary skill will readily recognize that the layer 14 can be formed of two or more parts or can include an air bladder or other suitable removable and replaceable cushioning material.

The padding layer 14 can be secured to the shell 12 or supported within the concavity 20 by known mechanical means, including pin and loop type fasteners, e.g., VELCRO®, cement and like mechanical fasteners. Other appropriate securing means suitable for use with the present invention will be obvious to one of ordinary skill in the art.

Referring again to FIGS. 1 and 2, the shell 12 includes a fastening or attachment assembly that comprises a pair of integral raised bridge structures 38 that protrude outwardly from the shell convex surface 16. Each bridge structure 38 includes a pair of support legs 40 and a transverse cross member 42 that expands between and connects the support legs 40. The bridge structures 38 are preferably molded onto the shell 12, but can be attached thereto by other known techniques, such as by gluing, cementing or riveting. When mounted thereto, each bridge 38 forms a strap-receiving aperture 44 that is sized to seat a corresponding head strap from known and commercially available headwear. The bridges 38 are axially aligned along axis A, FIG. 1, and the strap-receiving apertures 44 communicate to receive and secure the head strap to the device. The bridge structures can be composed of any strong durable material, similar to that of shell 12. Those of ordinary skill will also recognize that other mechanical structure can be provided to form the attachment assembly of the present invention. For example, a plurality of apertures or slits can be formed within the shell convex surface for mounting the head strap of conventional headwear.

According to another embodiment, the protective head device of the invention can be configured to be free of the foregoing attachment assembly. The device can be mounted to existing headwear by seating the device in an appropriate pocket or reservoir formed in the posterior portion of the headwear. Alternatively, an elastic band or strap or rigid rim can be mounted to the protective device 10 for placement over or about the head or over conventional headwear.

The shell 12 also includes a peripheral edge 22 that seats a molded edge piping 23. The piping 23 provides additional support about the peripheral edge of the shell, while concomitantly smoothing the edge of the device by providing a rounded edge contour. The piping can be made of known commercially available material, such as polypropylene.

The protective head covering 10 of the invention can be mounted to a variety of headwear that includes appropriate mechanical structure for attachment to the protective head covering of the present invention. According to a preferred practice, the head covering 10 is adapted for mounting to headwear having a conventional, adjustable head strap, such as baseball, football and hockey hats. The device of the invention can also be worn with other conventional headwear, including other protective headwear. Those of ordinary skill will also recognize that the protective covering 10 need not be attached to the headwear, and that conventional headwear lacking appropriate mounting structure can also be used with this device.

Figure 4:
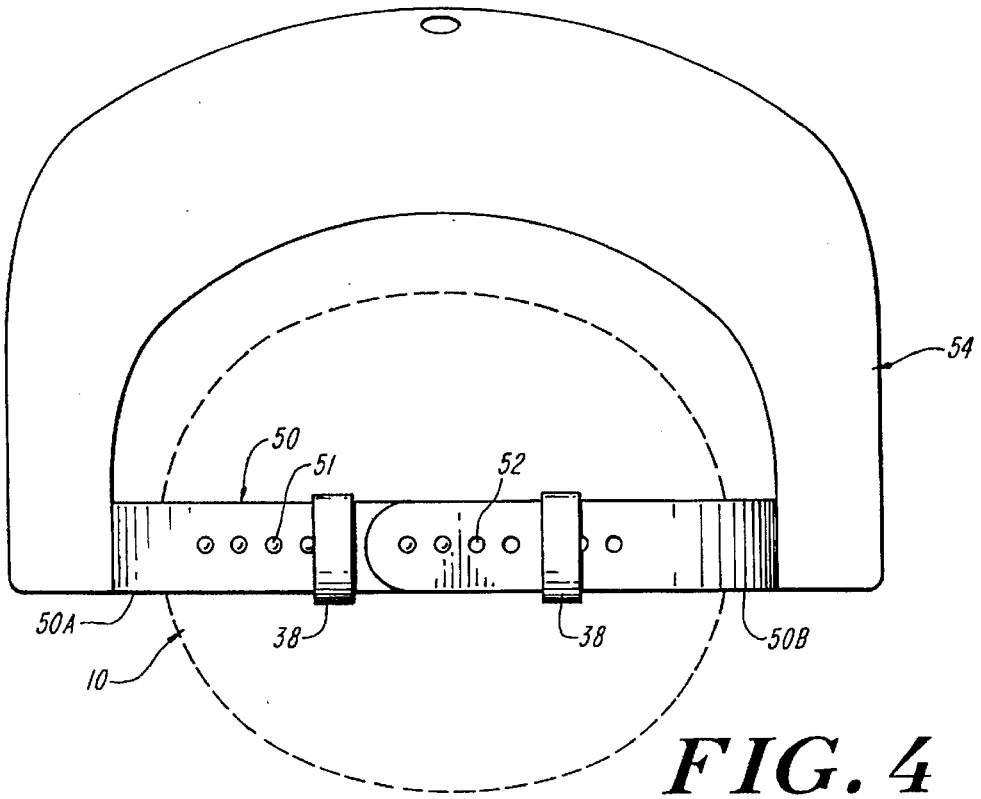
FIG. 4 is a rear view of the head covering of FIG. 1 mounted to the adjustable strap of conventional headwear.

In operation, as illustrated in FIGS. 1, 2 and 4, the head strap 50 of a conventional hat 54 is coupled with the bridge structures 38 of the head covering 10. Specifically, the aperture 44 of the bridge structure 38 slidably receives a corresponding strap 50A and 50B of the headwear 54. As illustrated, the straps secure to each other in a known snap-fit configuration. Specifically, a first head strap, e.g., head strap 50A, has a plurality of protrusions that extend outwardly therefrom, and a corresponding head strap 50B has a plurality of apertures formed therein. The mating engagement of the protrusions and apertures positively locks the straps 50A and 50B together.

When worn, the protective head covering 10 of the invention increases the total effective surface area of the wearer's head by adding size thereto. Thus, in mounting applications where a wearer's head would strain the mounting abilities of the headwear, the headwear may be unable to accommodate the protective covering. In these circumstances, an additional extender strap 60, FIGS. 3A–3C, can be employed. The illustrated extender strap 60 has a main body 62 that has integrally formed thereon and extending outwardly therefrom a plurality of aligned protrusions 64. Similarly, the strap 60 has formed therethrough a plurality of protrusion receiving apertures 66 also aligned with the protrusions 64. The extender strap 60 is adapted for use with the head straps of conventional headwear. The strap 60 is preferably formed of polyetheylene.

Figure 3A:
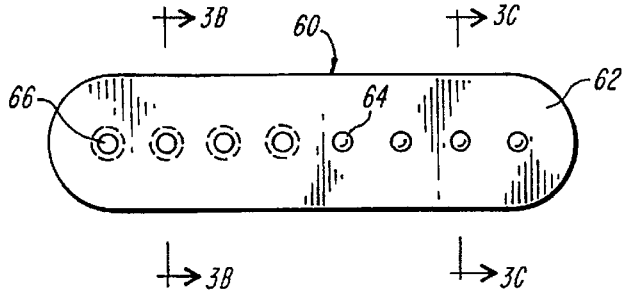
FIG. 3A is a top view of an extending strap element according to one feature of the present invention.
Figure 3B:
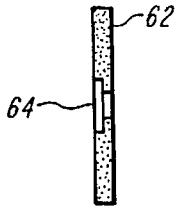
FIG. 3B is a cross-sectional view of the strap of FIG. 3A taken along line 3B—3B.
Figure 3C:
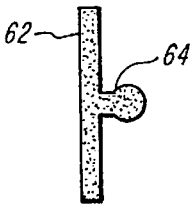
FIG. 3C is a cross-sectional view of the strap of FIG. 3A taken along line 3C—3C.

In use, as illustrated by FIG. 4 and with reference to FIGS. 3A–3C, the apertures 66 of the strap 60 seal the protrusions 51 of the head strap 50 to expand the size of the hat, thus accommodating larger head sizes. In particular, when the illustrated strap 60 is mounted over strap 50A, the protrusions 64 of strap 60 are available for use with the apertures 52 of strap 50B. This elongated head strap 50 can then be utilized with the protective head covering 10 as described above.

It will thus be seen that the invention efficiently attains the objects set forth above, among those made apparent from the preceding description. Since certain changes may be made in the above constructions without departing from the scope of the invention, it is intended that all matter contained in the above description or shown in the accompanying drawings be interpreted as illustrative and not in a limiting sense. For example, any number of bridge structures can be employed, as well as any number of the foregoing and above-described attachment assemblies.

It is also to be understood that the following claims are to cover all generic and specific features of the invention described herein, and all statements of the scope of the invention which, as a matter of language, might be said to fall therebetween.

Having described the invention, what is claimed as new and desired to be secured by Letters Patent is:

1. A protective head apparatus for protecting a portion of a wearer's head, the apparatus comprising a hard, impact resistant outer body portion having a convex outer surface and a concave inner surface and sized to seat exclusively over the posterior portion of the wearer's head, padding means forming a padding layer coupled to the concave inner surface of the outer body portion, and attachment means for mounting the apparatus to headwear, said attachment means including bridge means forming a raised bridge structure, said raised bridge being integrally formed with the convex outer surface of said body portion and protruding outwardly therefrom.

2. The apparatus of claim 1 wherein said padding means is sized to seat exclusively over the posterior portion of the wearer's head.

3. The apparatus of claim 1 further comprising means for securing the padding means to the outer body portion.

4. The apparatus of claim 1, wherein the headwear has an adjustable strap that couples with the raised bridge structure to secure the apparatus to the head of the wearer.

* * * * *